US005558014A

United States Patent [19]

Robinson

[11] Patent Number: 5,558,014

[45] Date of Patent: Sep. 24, 1996

[54] METHOD AND APPARATUS FOR BALING LOOSE MATERIALS

[75] Inventor: Lonnie R. Robinson, Matthews, N.C.

[73] Assignee: Lindemann Recycling Equipment, Inc., Charlotte, N.C.

[21] Appl. No.: 417,996

[22] Filed: Apr. 5, 1995

[51] Int. Cl.[6] ..... B30B 9/30

[52] U.S. Cl. ..... 100/35; 100/45; 100/218; 100/232; 100/252

[58] Field of Search ..... 100/35, 39, 41, 100/42, 45, 249, 218, 232, 240, 245, 246, 252

[56] References Cited

U.S. PATENT DOCUMENTS

| | | | |
|---|---|---|---|
| 1,766,642 | 6/1930 | Jacobson et al. . | |
| 3,408,923 | 11/1968 | Bushmeyer | 100/35 |
| 3,576,161 | 4/1971 | Wright | 100/25 |
| 3,613,556 | 10/1971 | Wright et al. | 100/14 |
| 3,643,590 | 2/1972 | Aluotto | 100/53 |
| 3,747,516 | 7/1973 | Wood | 100/38 |
| 3,810,421 | 5/1974 | Mosley | 100/95 |
| 4,086,850 | 5/1978 | Becker et al. | 100/42 |
| 4,185,446 | 1/1980 | Clostermeyer et al. | 56/344 |
| 4,205,604 | 6/1980 | Ashley | 100/95 |
| 4,417,510 | 11/1983 | Sharp | 100/249 |
| 4,658,719 | 4/1987 | Jackson et al. | 100/218 |
| 4,669,375 | 6/1987 | Newsom et al. | 100/45 |
| 4,676,153 | 6/1987 | Ast | 100/7 |
| 4,729,301 | 3/1988 | Smith et al. | 100/43 |
| 4,750,417 | 6/1988 | Newsom et al. | 100/35 |
| 4,787,308 | 11/1988 | Newsom et al. | 100/50 |
| 4,936,206 | 6/1990 | Miles et al. | 100/3 |
| 5,001,974 | 3/1991 | Gombos | 100/4 |
| 5,007,337 | 4/1991 | Newsom | 100/188 R |
| 5,081,922 | 1/1992 | Rudd et al. | 100/50 |
| 5,201,266 | 4/1993 | Schmalz et al. | 100/35 |
| 5,203,261 | 4/1993 | Davis | 100/42 |
| 5,347,921 | 9/1994 | Gourdol | 100/98 R |
| 5,463,944 | 11/1995 | Wolf et al. | 100/35 |

*Primary Examiner*—Stephen F. Gerrity
*Attorney, Agent, or Firm*—Bell, Seltzer, Park & Gibson, P.A.

[57] ABSTRACT

A method and apparatus for baling loose materials, such as waste material, includes a controllably moveable door assembly. In one embodiment, the door is adapted to open from an initial position to a final position such that the compacted bale can be ejected from the compaction chamber through the opening defined by the open door. In this embodiment, the leading edge portion of the door is moved to a final position in general alignment with the compacting ram platen such that bales of various sizes, including oversized bales, can be readily ejected from the baling apparatus. For example, the leading edge portion of the door can be moved into alignment with or rearward of the compacting ram platen. In another embodiment, the baling apparatus operates in a plug bale mode and includes a door which is urged against an at least partially ejected bale so as to securely hold the plug bale within the opening defined to the compaction chamber during the compaction of a succeeding bale. In particular, the door is partially closed until the speed with which the door is being closed is less than a predetermined speed. Once the speed with which the door is being closed falls below the predetermined speed, further closure of the door is halted and the plug bale is securely held within the opening due to the increased frictional forces provided by the partially closed door.

23 Claims, 4 Drawing Sheets

METHOD AND APPARATUS FOR BALING LOOSE MATERIALS

FIELD OF THE INVENTION

The present invention relates generally to methods and apparatus for baling loose materials and, more particularly, to a waste material baling apparatus having a controllably positioned door assembly and related methods of operation.

BACKGROUND OF THE INVENTION

A number of baling machines have been developed which compact loose materials, such as waste materials, into a relatively dense, compact bale. The compacted bales of waste material, often of a fairly uniform size, can then be more readily transported to a storage or disposal site at which they will occupy less space.

In particular, as the amount of available landfill space continues to diminish, the compaction of waste materials into dense, compact bales prior to their shipment and storage in a landfill becomes increasingly important in order to further reduce the space which the waste materials occupy within the landfill. In addition, with the increasing emphasis placed on environmental concerns and with the recent improvements in recycling technology which allow an even greater percentage of waste materials, such as paper, plastic and cans, to be recycled and reused, the baling of waste materials has become even more important since recyclable waste materials are generally compacted into a bale prior to their shipment to an appropriate recycling facility.

Conventional baling machines generally include a bin or hopper into which loose materials, such as waste material, are deposited. The deposited materials are generally collected in a charging passage defined within the baling machine. The charging passage is a longitudinally extending passage which typically has a parallelepiped shape, such as a rectangular solid shape.

Conventional baling machines also generally include a compacting ram assembly disposed within the charging passage and adapted for longitudinal movement therein. In particular, the compacting ram assembly generally includes a compacting ram platen which is adapted for reciprocating longitudinal movement through the charging passage between a retracted position and an extended position. In the retracted position, loose materials which are deposited in the hopper are collected in the charging passage. As the compacting ram platen is moved longitudinally forward from the retracted position to the extended position, the loose materials are urged through the charging passage and into a compaction chamber. The compaction chamber is also defined within the baling machine and is in communication with an exit end of the charging passage. Accordingly, the loose materials which are urged by the extending compacting ram platen through the charging passage are compacted into a bale within the compaction chamber.

The compaction chamber of such conventional baling machines generally has a rectangular solid shape having predetermined dimensions, including a predetermined width. In addition to the front face of the compacting ram platen in the extended position, the compaction chamber is typically defined by a floor, a ceiling and an end wall, opposite the compacting ram platen, which are fixed in position. The compaction chamber is further defined by a pair of opposed sidewalls which are adapted to cooperatively move so as to eject a compacted bale. In particular, once a bale has been formed in the compaction chamber, the bale is ejected such that the next bale can be compacted. The ejected bale can then be strapped or banded prior to shipment.

Conventional baling machines generally include a discharge ram assembly having a discharge ram platen for ejecting a compacted bale. Typically, the discharge ram assembly moves from a retracted position in which the discharge ram platen forms a first sidewall of the compaction chamber to an extended position by advancing the discharge ram platen through the compaction chamber such that the compacted bale is ejected therefrom. Generally, the discharge ram platen is longitudinally advanced in a direction perpendicular to the longitudinal axis of the charging passage.

Conventional baling machines typically operate in one of two modes, namely, a separation mode and a plug bale mode. In the separation mode, the second sidewall of the compaction chamber includes a door which is closed during the compaction operations and which opens once the compacted bale has been formed such that the compacted bale can be ejected from the compaction chamber. The door can then be closed prior to compacting the next bale.

In the plug bale mode, the second sidewall of the compaction chamber also includes a door. However, the door remains open during compaction operations in the plug bale mode and the rear portion of a previously compacted plug bale fills the opening in the sidewall of the compaction chamber during the compaction of the succeeding bale. Once the succeeding bale has been compacted, it can be ejected into the opening, thereby urging the previously compacted bale which had previously plugged the opening in the compaction chamber further downstream of the baling machine. The most recently compacted bale remains at least partially within the opening, however, to serve as the plug bale by filling the opening in the sidewall of the compaction chamber during the compaction of the succeeding bale.

The bales which are formed by conventional baling machines typically have a predetermined size as defined by the predetermined size of the compaction chamber. However, in some instances, oversized bales are formed. For example, the loose materials collected within the charging passage and urged by the compacting ram assembly into the compaction chamber can exceed the capacity of the compaction chamber, even following compaction, such that at least a portion of the compacted bale extends beyond the compaction chamber and into the charging passage.

In such instances, conventional baling machines are generally unable to eject the oversized bale from the compaction chamber since the door of conventional baling machines is adapted to open only to the predetermined width of the compaction chamber. Therefore, any attempts to eject the oversized bale from such conventional baling machines may damage the baling machine. Accordingly, upon formation of an oversized bale, the operator of the baling machine must generally temporarily suspend the baling operations and enter the compaction chamber to physically remove the excess material which extends beyond the compaction chamber such that the resulting bale fits within the compaction chamber and can be ejected. As will be apparent, this physical removal of the excess material is time-consuming, dangerous and laborious.

Accordingly, baling machines which are adapted to discharge oversized bales of compacted waste material have been developed. For example, U.S. Pat. No. 4,658,719 which issued Apr. 21, 1987 to Jerry L. Jackson, et al. and is assigned to Harris Press and Shear, Inc. discloses a mechanism for releasing oversized bales from a waste material baler. The waste baling machine of the Jackson '719 patent includes a discharge passage into which a compacted bale is ejected. The discharge passage has a predetermined width which defines the maximum width of a bale.

The discharge passage of the waste baling machine of the Jackson '719 patent includes a sidewall consisting of inner and outer sections. During the compaction and ejection of bales of the predetermined size, the inner and outer sidewall sections are positioned in a laterally adjacent relationship. However, upon the compaction of an oversized bale, the inner sidewall section can be lifted vertically and placed upon the outer sidewall section. Accordingly, the effective width of the discharge passage sidewall is decreased and, consequently, the width of the discharge passage is correspondingly increased. Thus, an oversized bale can then be ejected from the baling machine. However, the inner wall section of the waste baling machine of the Jackson '719 patent is generally relatively thick such that the vertical movement of the inner wall section requires a relatively large lifting force, typically supplied by a hydraulic motor. In addition, the inner and outer walls must be precisely machined such that the mating wall surfaces of the inner and outer wall sections can be slidably engaged.

Another waste material baling machine having a mechanism for discharging oversized bales is disclosed by U.S. Pat. No. 5,007,337 which issued Apr. 16, 1991 to Horace R. Newsom and is assigned to Mosely Machinery Company, Inc. The Newsom '337 patent discloses a horizontal waste baling machine which also includes a discharge passage, adjacent to and downstream of the compaction chamber and into which the compacted bales are ejected. In addition, the waste material baling machine of the Newsom '337 patent can include a discharge passage sidewall, adjacent the exit end of the charging passage. The exit end of the charging passage is generally defined as the end of the charging passage adjacent the compaction chamber.

The discharge passage sidewall defines the width of the discharge passage and, consequently, the maximum width of the compacted bale. In operation, the discharge passage sidewall has a normal position which defines the predetermined width of the standard compacted bales. In addition, the discharge passage sidewall is adapted to move a predetermined distance "d" laterally outward to a wider position in order to increase the width of the discharge passage such that an oversized bale can be discharged. Thus, the discharge passage sidewall of the waste material baling machine of the Newsom '337 patent has two positions, namely, a normal position and a wider position in which the discharge passage sidewall has been moved laterally outward by a predetermined distance "d"

As described above, some baling machines can operate in the plug bale mode, in which a previously compacted plug bale is disposed within an opening in the compaction chamber during the compaction of the succeeding bale. During the compaction process, however, the material in the compaction chamber is subjected to relatively large forces. Accordingly, the compaction chamber itself, including the previously compacted plug bale, must be adapted to withstand such large forces.

Typically, the plug bale is held within the opening in the sidewall of the compaction chamber by frictional forces between the bale and the discharge passage. In some instances, such as instances in which the plug bale has a relatively high moisture content or is slightly undersized, the frictional forces holding the plug bale within the opening defined in the compaction chamber can be overcome by the forces exerted on the material in the compaction chamber such that the plug bale is forced from the opening and advances in the discharge passage. Consequently, the bale being formed within the compaction chamber will typically be misshaped or missized due to the movement of the plug bale from the opening.

In order to further secure the plug bale within the opening defined in the sidewall of the compaction chamber, U.S. Pat. No. 5,081,922 which issued Jan. 21, 1992 to Brody W. Rudd, Jr., et al. and is assigned to C & M Company discloses a device for controlling the discharge of a bale from a solid waste baling machine. The waste baling machine of the Rudd '922 patent includes a discharge passage which is aligned with and in communication with the compaction chamber. Once the waste baling machine of the Rudd '922 patent has completed the compaction operations, the compacted bale is discharged through an opening in a sidewall of the compaction chamber and into the discharge passage. However, a rear portion of the compacted bale is retained within the opening in the sidewall of the compaction chamber as a plug bale during the compaction of the succeeding bale.

The longitudinally extending discharge passage of the waste baling machine of the Rudd '922 patent is defined by top and bottom plates and a fixed sidewall. The discharge passage is further defined by a laterally moveable sidewall which is mounted for lateral inward and outward incremental movement in a direction perpendicular to the longitudinal axis of the discharge passage. In particular, the laterally moveable sidewall is mounted for incremental movement inward and outward from a predetermined position in alignment with the exit end of the charging passage. Thus, the laterally moveable sidewall can be incrementally moved laterally inward following the ejection of a bale to press against and to increase the frictional forces on the ejected bale in the discharge passage during the compaction of the succeeding bale. Consequently, the ejected bale is maintained in position within the opening defined in the sidewall of the compaction chamber during the compaction of the succeeding bale.

Once a bale has been compacted by the waste baling machine of the Rudd '922 patent, it is ejected into the discharge passage. However, if there is excessive resistance to the ejection of the compacted bale, such as in instances in which the most recently compacted bale is larger than the previously compacted plug bale, the laterally moveable sidewall can also be incrementally retracted from the predetermined position in alignment with the exit end of the charging passage to reduce the resistance to the ejection of the compacted bale so as to thereby allow the compacted bale to be discharged into the discharge passage. Thereafter, the laterally moveable sidewall can again be incrementally moved laterally inward to more securely hold the plug bale in position during compaction of the succeeding bale.

SUMMARY OF THE INVENTION

It is therefore an object of the present invention to provide an improved method and apparatus for ejecting compacted bales of waste material.

It is another object of the present invention to provide an improved method and apparatus for ejecting compacted bales of waste material without damaging the baling apparatus.

It is a further object of the present invention to provide an improved method and apparatus for controllably ejecting an oversized bale from a baling machine.

It is yet another object of the present invention to provide an improved method and apparatus for securely holding a plug bale at least partially within an opening defined in the sidewall of the compaction chamber of a baling machine.

These and other objects are provided, according to the present invention, by a method and apparatus for baling loose materials, such as waste material, and which includes a controllably positioned door assembly. In one embodiment, the door assembly is adapted to be moved to a final position in which the leading edge portion of the door is in general alignment with the compacting ram platen. Therefore, the opening from the compaction chamber defined by the open door has a size that corresponds to the position of the compacting ram platen and, consequently, is at least as wide as the compacted bale such that bales of varying widths, including oversized bales, can be ejected.

In another embodiment in which the baling apparatus operates in a plug bale mode, the door assembly includes door closure means for partially closing the door such that the leading edge portion of the door is urged against an at least partially ejected bale. In particular, the door closure means includes a speed sensor for repeatedly determining the speed with which the door is being closed and a door positioning controller for halting further closure of the door once the speed sensor determines that the speed with which the door is being closed is less than a predetermined speed. By appropriately selecting the predetermined speed, the ejected bale is securely held at least partially within the opening to the compaction chamber during subsequent compaction operations.

The apparatus for baling loose materials generally includes a housing defining a charging passage, such as a longitudinally extending charging passage, which is adapted for receiving the loose materials. The housing also defines a compaction chamber in communication with the charging passage. A compacting ram assembly is preferably disposed at least partially within the charging passage and is adapted for movement, such as longitudinal movement, therein. In particular, the compacting ram assembly moves between a retracted position and an extended position. The compacting ram assembly includes a compacting ram platen for urging the loose materials which are received within the charging passage into the compaction chamber and for compacting the loose materials within the compaction chamber into a bale as the compacting ram assembly moves from the retracted position to the extended position. Once a bale is formed, the movement of the compacting ram assembly and, in particular, the movement of the compacting ram platen is generally halted, such as by a compacting ram controller.

The baling apparatus of the present invention also preferably includes a movable door assembly including a door movably mounted to the housing and having a leading edge portion. According to one embodiment, the leading edge portion of the door is moved, such as in a longitudinally rearward direction, from an initial position to a final position. The final position is in general alignment with the compacting ram platen to thereby define an opening from the compaction chamber through which compacted bales of varying widths can be ejected. In one embodiment, the leading edge portion of the door is moved to a final position which is aligned with compacting ram platen. In another embodiment, the leading edge portion of the door is moved to a final position which is rearward of the compacting ram platen. Since the compacting ram platen defines the maximum width of the compacted bale, a bale, such as an oversized bale, can be ejected once the door has been moved to a position in general alignment with the compacting ram platen.

The actuation means of the movable door assembly can include a door position sensor, mounted in a predetermined positional relationship to the door, for producing signals indicative of the position of the door. The actuation means can also include a door positioning controller for determining the position of the door based upon the signals produced by the door position sensor. In addition, the actuation means can include a hydraulic actuator for moving the door from the initial position to the final position in response to the door positioning controller.

The compacting ram controller can also include a compacting ram position sensor, mounted in a predetermined positional relationship to the compacting ram platen, for producing signals indicative of the position of the compacting ram platen. Thus, a bale of a predetermined width can be formed. In this embodiment, the door positioning controller is preferably responsive to the compacting ram controller such that the position of the door relative to the position of the compacting ram platen can be determined once the compacting ram assembly is halted.

The baling apparatus of the present invention can also include a discharge ram assembly including a discharge ram platen. The discharge ram platen is adapted to move through the compaction chamber from a retracted position to an extended position once the compacting ram assembly is halted and the doors have been moved to the final position. Thus, the compacted bale can be ejected through the opening to the compaction chamber defined by the open door. Typically, the discharge ram platen forms a portion of the compaction chamber in the retracted position.

In another embodiment in which the baling apparatus of the present invention operates in a plug bale mode, the door assembly includes the door closure means for partially closing the door such that the leading edge portion of the door is urged against an at least partially ejected bale. Consequently, the bale is retained at least partially within the opening to the compaction chamber during the compaction of the succeeding bale. The door closure means includes the speed sensor for repeatedly determining the speed at which the door is being closed. In addition, the door positioning controller of this embodiment is responsive to the speed sensor so as to halt further closure of the door once the speed sensor determines that the speed with which the door is being closed is less than the predetermined speed. Thus, the frictional force with which the plug bale is held within the opening can be controlled to prevent undesirable slippage of the plug bale from the opening during the compaction of the succeeding bale.

The door closure means can also include a hydraulic actuator for partially closing the door. In this embodiment, the door positioning controller can also include a pressure sensor for repeatedly providing signals indicative of the hydraulic pressure supplied to the hydraulic actuator to partially close the door. Consequently, the door positioning controller of this embodiment can also halt further closure of the door once the hydraulic pressure supplied to the hydraulic actuator exceeds a predetermined pressure. Thus, once the speed with which the door is being closed is less than the predetermined speed or once the hydraulic pressure required to close the door exceeds a predetermined pressure value, further closure of the door is halted and the ejected bale is held, as a plug bale, at least partially within the opening to the compaction chamber.

The speed sensor can include a position sensor, mounted in a predetermined positional relationship to the door, for producing signals indicative of the position of the door. In addition, the speed sensor can include a timer for determining the respective times at which the signals indicative of the position of the door are produced by the position sensor. Thus, the speed with which the door is being closed can be determined.

In addition, the leading edge portion of the door can include an outwardly extending flanged portion having a contact surface for contacting and securely holding the ejected bale at least partially within the opening to the compaction chamber. In this embodiment, the baling apparatus can include a discharge chute adjacent to the opening to the compaction chamber. The discharge chute includes a support surface for supporting the ejected bale and an upwardly extending sidewall extending upwardly from an edge portion of the support surface. Thus, the ejected bale can be disposed between the upwardly extending sidewall and the contact surface of the door.

Therefore, according to one embodiment of the present invention, the door of the loose materials baling apparatus can be controllably opened to a final position in general alignment with the compacting ram platen to define an opening from the compaction chamber having a size that corresponds to the position of the compacting ram platen and through which compacted bales, of varying widths, including oversized bales, can be ejected. In addition, according to another embodiment of the present invention, the door can be controllably closed against a plug bale such that the plug bale is securely held within the opening to the compaction chamber during the compaction of a succeeding bale so as to prevent slippage of the plug bale from the opening.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
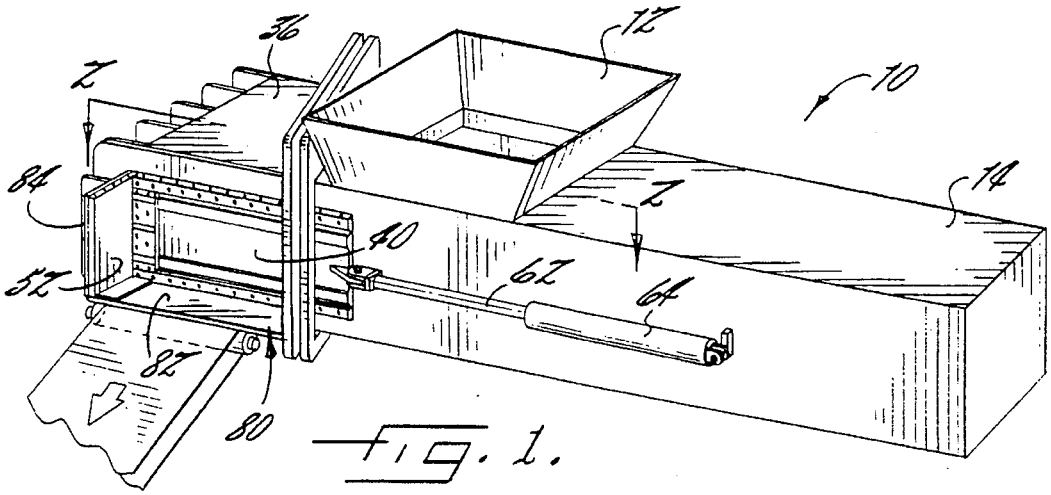
FIG. 1 is a perspective view of an apparatus for baling loose materials according to one embodiment of the present invention.

Referring now to FIG. 1, an apparatus 10 for baling loose materials, such as waste materials, according to the present invention is illustrated. The baling apparatus includes a bin or hopper 12 into which loose materials, such as recyclable waste materials including cans, plastics and paper, can be deposited. The hopper is generally mounted to an upper portion of the housing 14 of the baling apparatus and is in communication with a charging passage 16 defined within the housing such that the charging passage receives the loose materials which are deposited within the hopper. As shown in more detail in FIG. 2, the charging passage of one embodiment extends longitudinally through the housing and defines a longitudinal axis 16*a* therethrough. Typically, the charging passage has a parallelepiped shape and, more typically, has a rectangular solid shape.

A compacting ram assembly 18 can be disposed at least partially within the charging passage 16. The compacting ram assembly generally includes a compacting ram platen 20 which is adapted for movement, such as longitudinal movement, through the charging passage between a retracted position and an extended position. For illustrative purposes, the compacting ram platen in the extended position is shown in solid lines in FIG. 2 and the compacting ram platen in the retracted position is shown in dotted lines. The compacting ram platen is typically hydraulically actuated. Thus, the compacting ram assembly also generally includes a longitudinally extending hydraulic cylinder 22 and a hydraulic pressure source (not illustrated) for actuating the compacting ram platen.

Figure 2:
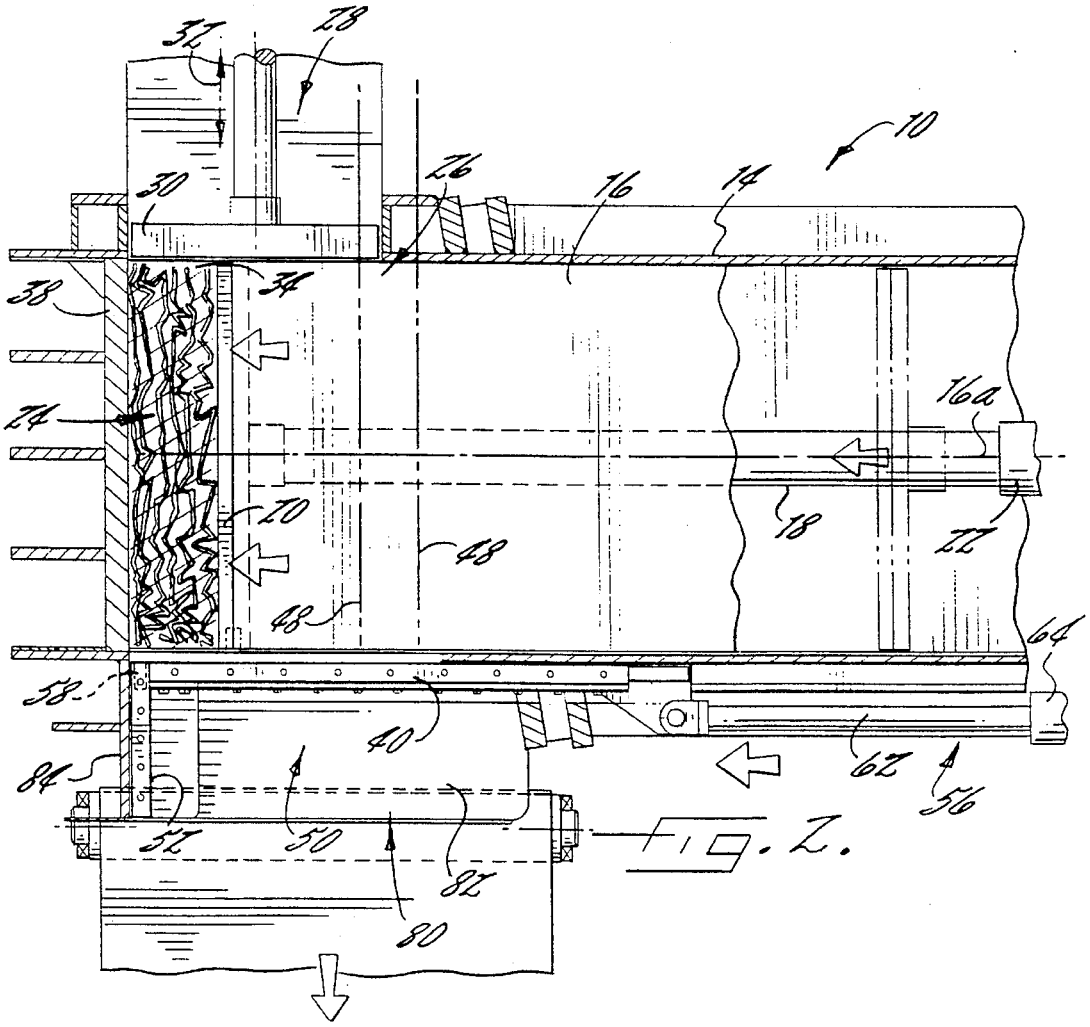
FIG. 2 is a fragmentary perspective view of the baling apparatus of FIG. 1 taken along line 2—2 and illustrating the extended and retracted positions of both the compacting ram assembly and the discharge ram assembly.

As the compacting ram platen 20 moves longitudinally forward from the retracted position to the extended position, the loose materials which are received within the charging passage 16 are urged into a compaction chamber 24. As also illustrated in FIG. 2, the compaction chamber is defined within the housing 14 and is in communication with an exit end 26 of the charging passage. The longitudinally forward movement of the compacting ram platen not only urges the loose materials into the compaction chamber, but also compacts loose materials into a bale. Typically, the compacting ram assembly reciprocates within the charging passage such that additional loose materials are received within the charging passage while the compacting ram assembly is in the retracted position. The additional materials can then be added to the bale during the next longitudinally forward movement of the compacting ram platen.

The baling apparatus 10 of the present invention also generally includes discharge means, such as a discharge ram assembly 28 which is at least partially disposed within the compaction chamber 24. The discharge ram assembly includes a discharge ram platen 30 which is adapted to move through the compaction chamber between a retracted position and an extended position. For example, the discharge ram platen is shown in the retracted position in FIG. 2 and in a partially extended position in FIGS. 5 and 7. In particular, the discharge ram assembly generally moves in a direction indicated by arrow 32 which is substantially perpendicular to the longitudinal axis 16*a* of the charging passage 16. By moving the discharge ram platen through the compaction chamber from the retracted position to the extended position, the compacted bale can be ejected as described hereinafter. Although not illustrated, the discharge ram assembly is preferably hydraulically actuated and can therefore also include a hydraulic cylinder and an associated hydraulic pressure source.

The compaction chamber 24 is generally defined by a floor 34, a ceiling 36 and an end wall 38, each of which are typically fixed in position. In addition, the front surface of the compacting ram platen 20 in the extended position generally defines a wall of the compaction chamber, opposite the fixed end wall. Furthermore, a first sidewall of the compaction chamber is generally formed by the front surface of a discharge ram platen 30 of a discharge ram assembly 28 in the retracted position.

The baling apparatus 10 of the present invention can operate in either a separation mode or a plug bale mode. In the separation mode, a second sidewall of the compaction chamber 24, opposite the front face of the discharge ram platen 30, is formed by a movable door 40. The door is closed during compaction operations and is adapted to open following the compaction of a bale to allow the compacted bale to be ejected through the opening thereby exposed in the compaction chamber. The door can then be closed prior to the compaction of the succeeding bale.

Alternatively, in the plug bale mode, a previously compacted plug bale is held within the opening from the compaction chamber 24 defined by the open door 40 during the compaction of a succeeding bale. Consequently, the second sidewall of the compaction chamber, opposite the front face of the discharge ram platen 30, is formed, at least partially, by a rear portion of the plug bale filling the opening defined by the open door.

Figure 3:
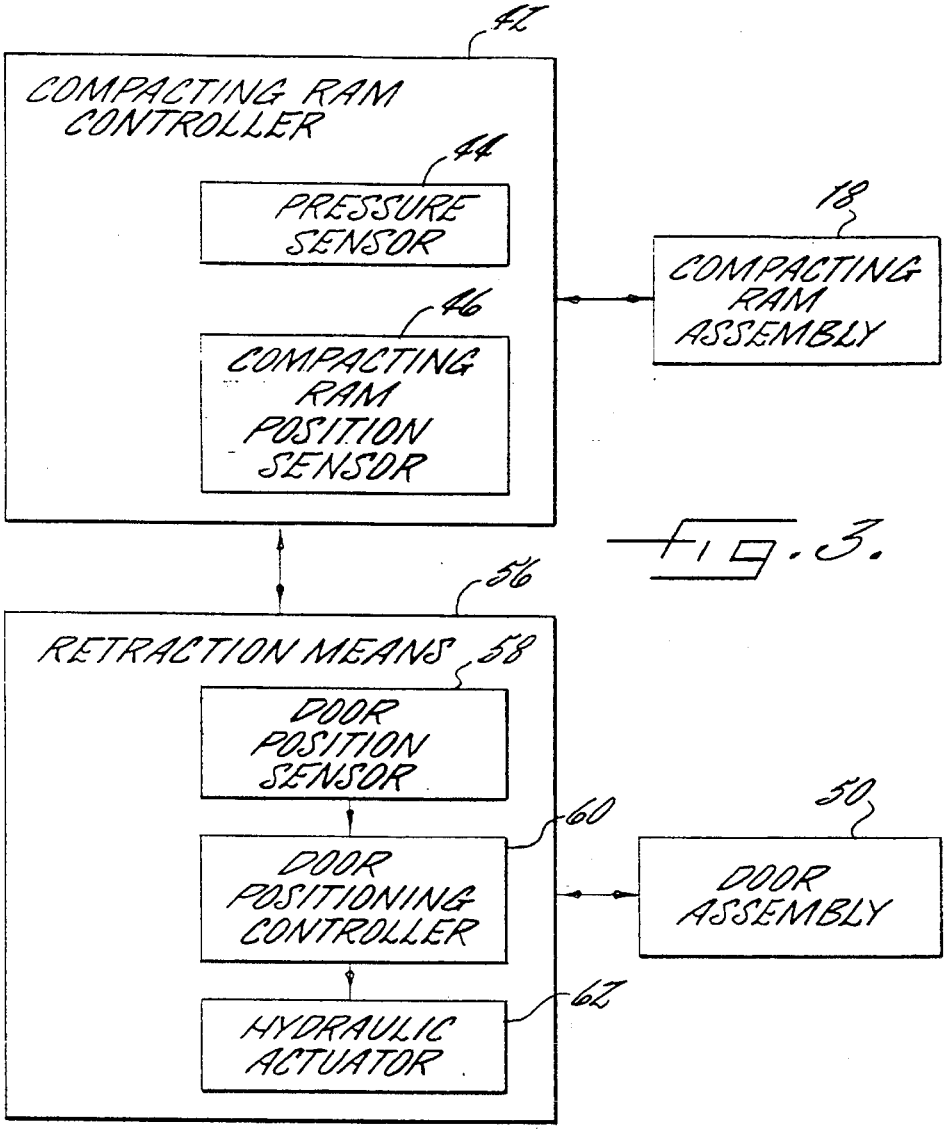
FIG. 3 is a block diagram illustrating the compacting ram controller and the actuation means of one embodiment of the baling apparatus of the present invention.
Figure 8:
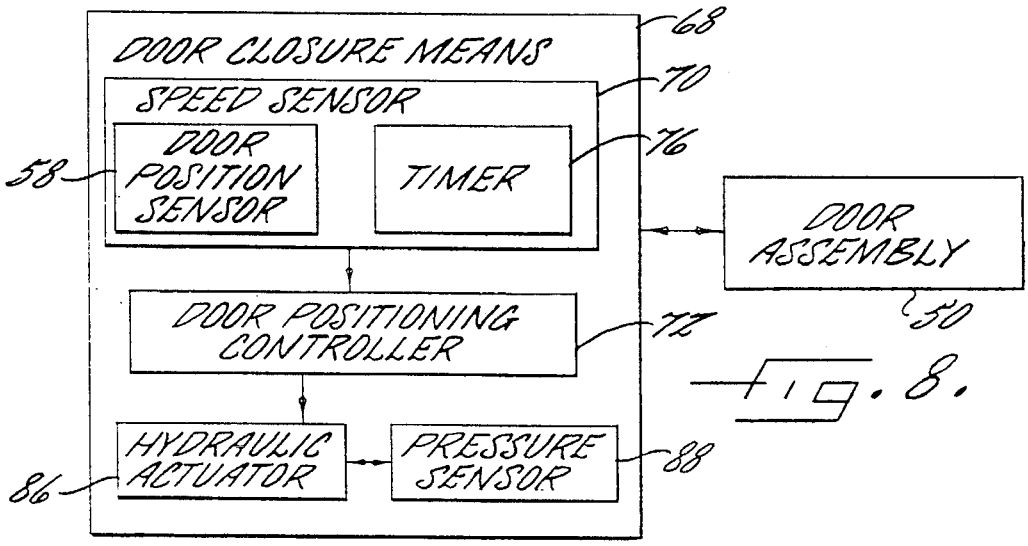
FIG. 8 is a block diagram illustrating the relationship of the door closure means and the door assembly of one embodiment of the baling apparatus of the present invention.

As illustrated in block diagram form in FIG. 3, the baling apparatus 10 of the present invention preferably includes a compacting ram controller 42, such as a programmable logic controller, for controlling the movement of the compacting ram assembly 18. Preferably, movement of the compacting ram assembly is halted once a bale is formed. Various methods can be employed to determine when a bale has been formed without departing from the spirit and scope of the present invention.

For example, for a hydraulically actuated compacting ram assembly 18, a predetermined maximum hydraulic pressure can be selected. The compacting ram platen 20 can then be urged longitudinally forward within the charging passage 16 until the hydraulic pressure required to move the compacting ram platen equals the predetermined maximum hydraulic pressure. Once the predetermined maximum hydraulic pressure is reached, the longitudinal advancement of the compacting ram assembly can be halted. Accordingly, the compacting ram controller 42 of the embodiment preferably includes a pressure sensor 44 for determining the hydraulic pressure required to move the compacting ram platen forward.

The compacting ram controller 42 also preferably includes a compacting ram position sensor 46, mounted in a predetermined positional relationship to the compacting ram platen 20, for producing signals indicative of the position, such as the longitudinal position, of the compacting ram platen relative to the housing 14. According to the embodiment described above, once the predetermined maximum hydraulic pressure is reached and the longitudinal advancement of the compacting ram platen is halted, the compacting ram controller can determine the longitudinal position of the compacting ram platen. The compacting ram controller can then compare the longitudinal position of the compacting ram platen to a predetermined longitudinal position or to a predetermined range of longitudinal positions generally selected to define the nominal width of a compacted bale. For example, a predetermined range of longitudinal positions is illustrated by the pair of dotted lines 48 in FIG. 2.

Figure 4:
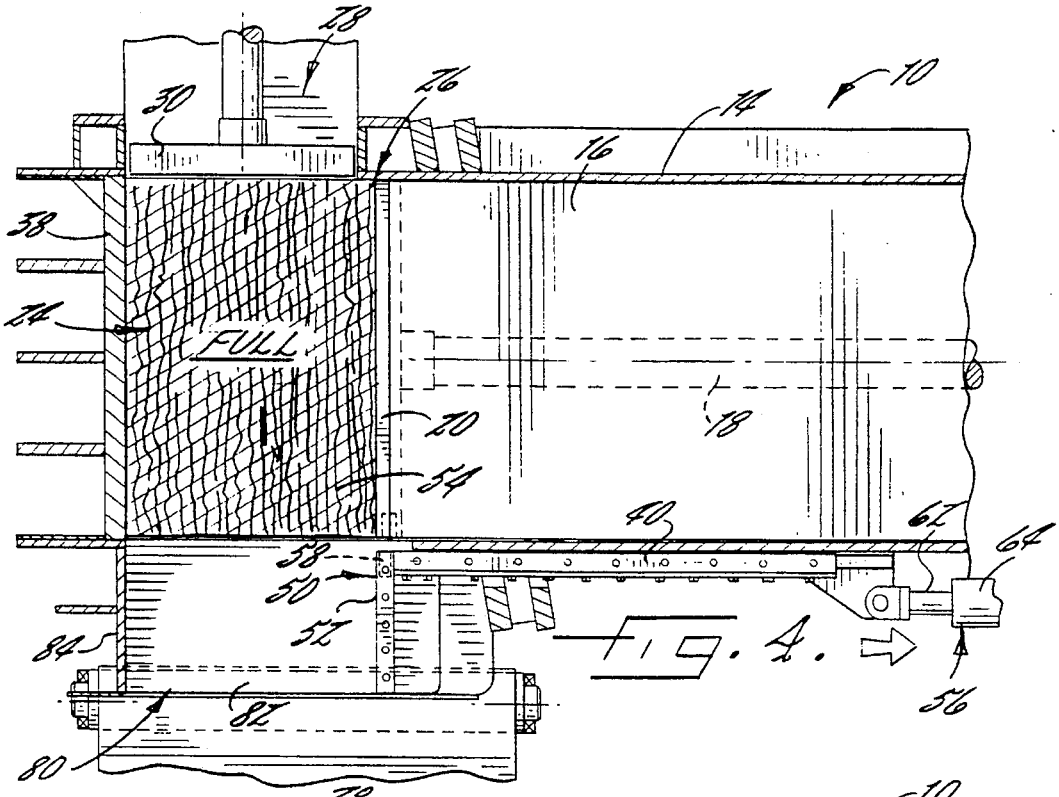
FIG. 4 is a fragmentary cross-sectional view of the baling apparatus of FIG. 1 illustrating the alignment of the open door with the compacting ram platen.

If the compacting ram platen 20 is longitudinally beyond or forward of the predetermined longitudinal position 48, the compacting ram assembly 18 is preferably longitudinally retracted to the retracted position such that additional loose materials can be received within the charging passage 16. The compacting ram platen can then be longitudinally advanced through the charging passage again to compact the additional loose materials into the compacted bale. However, if the longitudinal position of the compacting ram platen is equal to or longitudinally rearward of the predetermined longitudinal position, the reciprocating longitudinal movement of the compacting ram platen is halted, such as in the extended position as shown in FIG. 4.

The baling apparatus 10 of the present invention also includes a moveable door assembly 50. The door assembly includes a door 40 having a leading edge portion 52. The door is movably mounted to the housing 14 and is adapted to open to thereby define the opening from the compaction chamber 24 through which the compacted bale is at least partially ejected, such as by the discharge ram assembly 28. For example, the ejection of a bale 54 through the opening to the compaction chamber defined by the open door is shown in FIG. 5.

In one embodiment, the door assembly 50 includes actuation means 56 for moving the door 40 from an initial position to a final position. Typically, the actuation means moves the door to the final position once the compacting ram assembly 18 has been halted. In particular, the actuation means moves the leading edge portion 52 of the door to the final position which is in general alignment with the compacting ram platen 20. By moving the leading edge portion of the door to a final position which is in general alignment with the compacting ram platen, the opening from the compaction chamber 24 which is thereby exposed has a size that corresponds to the position of the compacting ram platen and, more particularly, has a width at least as large as the maximum width of the compacted bale 54, including an oversized bale.

The door 40 can be mounted to move in a variety of motions relative to the housing 14 without departing from the spirit and scope of the present invention. For example, the door can be mounted to pivot so as to expose the opening from the compaction chamber 24 through which compacted bales 54 are ejected. For illustrative purposes, however, a door mounted for longitudinal movement is illustrated and will be described in detail hereinafter. In this embodiment, the actuation means 56 moves the door longitudinally, such as in a continuous longitudinal movement, from the initial position to the final position in which the leading edge portion 52 of the door is in general longitudinal alignment with the compacting ram platen 20. More particularly, the leading edge portion of the door of this embodiment is in general alignment with the compacting ram platen when the leading edge portion of the door is at least as longitudinally rearward as the compacting ram platen as described below.

Figure 5:
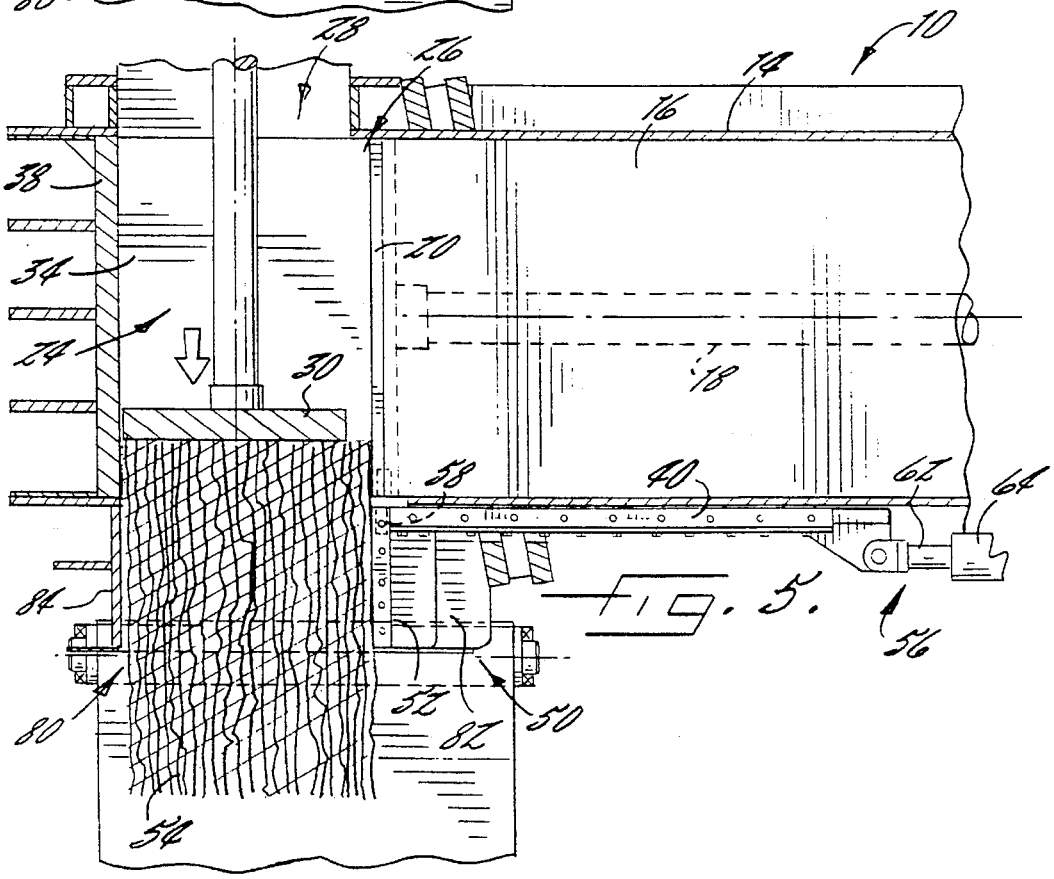
FIG. 5 is a fragmentary perspective view of the baling apparatus of one embodiment of the present invention during the ejection of a compacted bale through the opening to the compaction chamber defined by the open door which is aligned with the compacting ram platen.

In the embodiment illustrated in FIGS. 4 and 5, the actuation means 56 includes means for moving the leading edge portion 52 of the door 40 longitudinally to a final position which is longitudinally aligned with the compacting ram platen 20 and, in particular, which is longitudinally aligned with the front face of the compacting ram platen. In another embodiment illustrated in FIG. 7, the actuation means includes means for moving the leading edge portion of the door longitudinally to a final position which is longitudinally rearward of the compacting ram platen and, in particular, which is longitudinally rearward of the front face of the compacting ram platen.

The actuation means 56 can include a door position sensor 58. For example, the door position sensor can be an optical sensor or a linear position transduscer, such as the linear position transducer distributed by Celesco Transducer Products, Inc. The door position sensor is generally mounted in a predetermined positional relationship to the door 40, such as along the leading edge portion 52 of the door as illustrated schematically in FIGS. 3–5. The door position sensor produces signals indicative of the position, such as the longitudinal position, of the door relative to the housing 14.

The actuation means 56 of this embodiment can also include a door positioning controller 60, responsive to the signals produced by the door position sensor 58. The door positioning controller determines the position of the door 40 relative to the housing 14. The actuation means can further include a hydraulic actuator 62, responsive to the door positioning controller, for moving the door longitudinally from the initial position to the final position. Typically, the door is moved longitudinally rearward from the initial position to the final position, but, in some instances, the door can be moved longitudinally forward to the final position. In this embodiment, the hydraulic actuator includes a hydraulic cylinder 64 and a hydraulic pressure source (not illustrated). However, other means of moving the door from the initial position to the final position can be employed without departing from the spirit and scope of the present invention.

The door positioning controller 60 is preferably responsive to the compacting ram controller 42 such that the position of the door 40 can be determined relative to the position of the compacting ram platen 20, such as once the compacting ram assembly 18 is halted. Preferably, the longitudinal position of the leading edge portion 52 of the door is determined relative to the longitudinal position of the front face of the compacting ram platen once the compacting ram assembly is halted. Thus, the door can be accurately moved longitudinally to a final position which is in general alignment with the compacting ram platen.

Therefore, regardless of the mode of operation, the leading edge portion 52 of the door 40 can be moved to a final position which is in general alignment with the compacting ram platen 20 such that compacted bales 54 of various sizes and widths can be readily ejected. In particular, oversized bales, that is, bales having a width greater than the predetermined width of the compaction chamber, can be ejected without damaging the baling apparatus 10 and without requiring an operator to temporarily suspend operations in order to remove portions of the compacted bale prior to its ejection.

Figure 6:
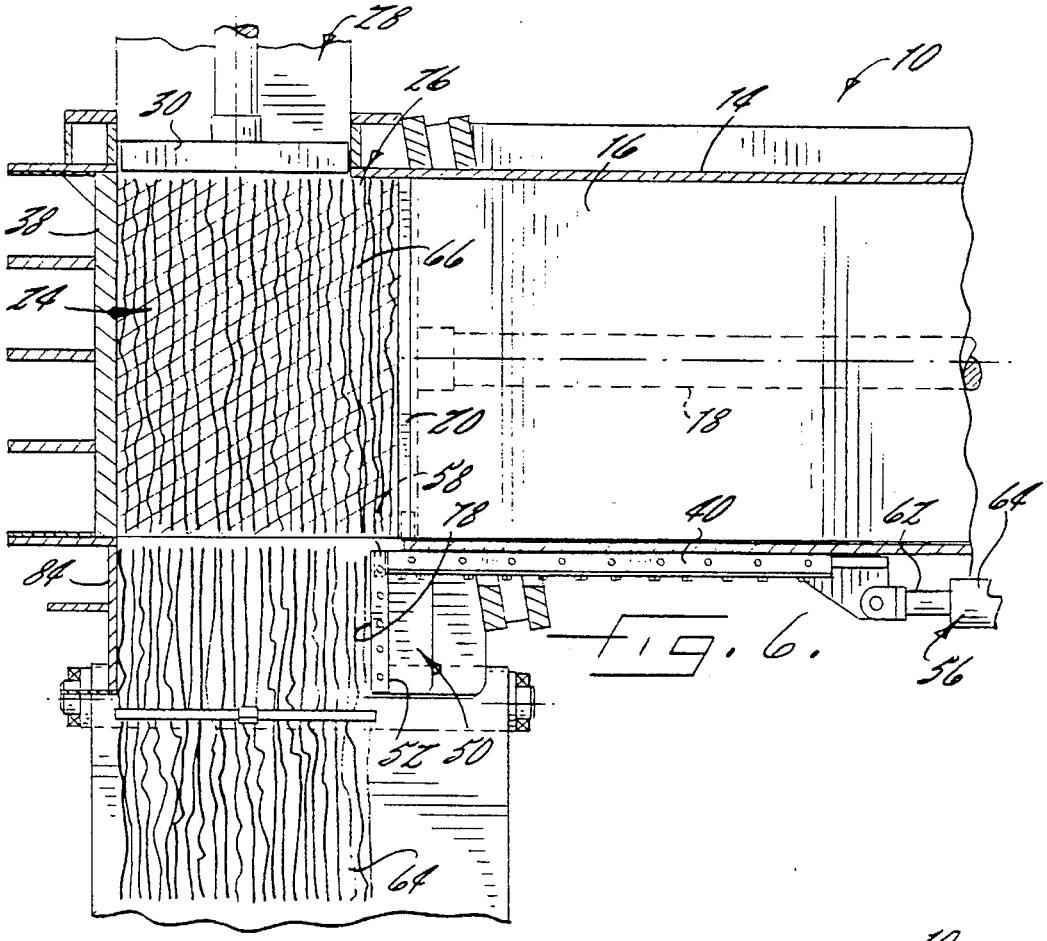
FIG. 6 is a fragmentary cross-sectional view of the baling apparatus of FIG. 1 in operation in plug bale mode in which a plug bale is held within the opening to the compaction chamber defined by the open door during the compaction of a succeeding bale.

As described above, the baling apparatus 10 of the present invention is also adapted to operate in a plug bale mode in which a plug bale is securely retained within the opening to the compaction chamber 24 defined by the open door 40 during subsequent compaction operations as shown in FIG. 6. In this embodiment, the door assembly 50 includes door closure means 68 for partially closing the door such that the leading edge portion 52 of the door is urged against the at least partially ejected bale 64. Therefore, the rear portion of the at least partially ejected bale is retained within the opening to the compaction chamber during the compaction of the succeeding bale 66. By controllably closing the door against the plug bale, however, the frictional forces which secure the plug bale within the opening are increased, so as to prevent undesirable slippage of the plug bale during the subsequent compaction operations.

According to this embodiment, the door closure means 68 includes a speed sensor 70 for repeatedly determining the speed with which the door 40 is being closed. The door closure means can also include a door positioning controller 72, such as a programmable logic controller, which is responsive to the speed sensor for halting further closure of the door once the speed sensor determines that the speed with which the door is being closed is less than a predetermined speed. The door positioning controller of the door closure means and the actuation means 56 can be the same controller or separate controllers can be employed without departing from the spirit and scope of the present invention. In either event, the ejected bale 64 can be securely held by the door closure means at least partially within the opening to the compaction chamber 24 once the closure rate of the door falls below a predetermined speed.

In one embodiment, the speed sensor 70 includes a door position sensor 58, mounted in the predetermined positional relationship to the door 40, such as along a leading edge portion of the door as shown schematically in FIGS. 4 and 5, for producing signals indicative of the position of the door. As described above in conjunction with the door positioning controller, the door position sensors of the door closure means 68 and the actuation means 56 can be the same sensor or can be separate sensors without departing from the spirit and scope of the present invention. The speed sensor can also include a timer 76 for determining the respective times at which the signals indicative of the position of the door are produced by the door position sensor. Based upon the time rate of change of the position of the door as determined by the door position sensor and the associated timer, the speed with which the door is being closed can be readily determined by the door positioning controller 72.

As illustrated in FIGS. 4–7, the leading edge portion 52 of the door 40 of this embodiment preferably includes an outwardly extending flanged portion. The outwardly extending flanged portion has a contact surface 78 for contacting and securely holding the ejected bale 64 at least partially within the opening to the compaction chamber 24. For example, the flanged portion can extend outwardly from the housing approximately one foot. Thus, the frictional forces which secure the plug bale within the opening are further increased by the enlarged surface area of the contact surface of this embodiment of the leading edge portion of the door.

As further illustrated in FIGS. 1 and 2, the baling apparatus 10 can include a discharge chute 80. The discharge chute is adjacent to and downstream of the opening to the compaction chamber 24. The discharge chute generally includes a support surface 82 for supporting the ejected bale and a sidewall 84 which extends upwardly from an edge portion of the support surface. Typically, the upwardly extending sidewall is generally coplanar with the end wall 38 of the housing 14 which defines a portion of the compaction chamber.

Figure 7:
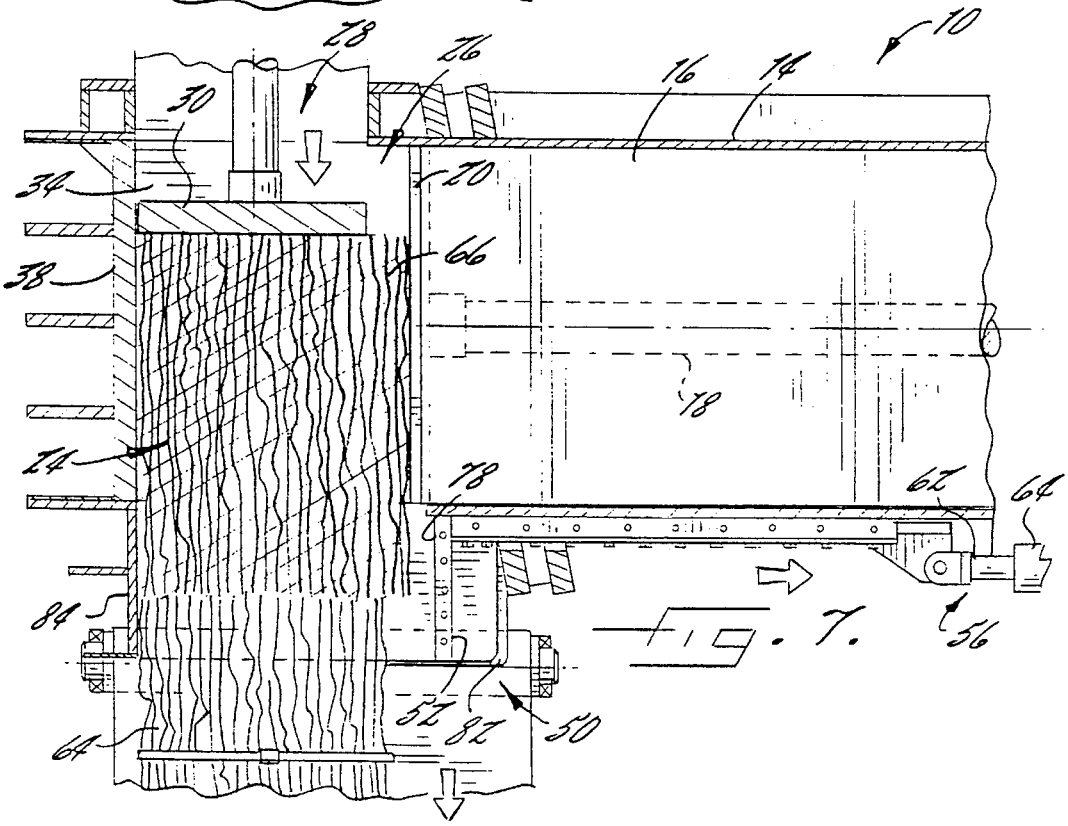
FIG. 7 is a fragmentary cross-sectional view of the baling apparatus of FIG. 1 illustrating the leading edge portion of the door in a final position which is rearward of the compacting ram platen during the ejection of a compacted bale which, in turn, urges the plug bale further downstream from the baling apparatus.

Thus, the discharge means of this embodiment, such as the discharge ram assembly 28, preferably ejects the compacted bale at least partially through the opening such that a rear portion of the compacted bale remains within and fills the opening defined by the opened door 40. As illustrated in FIGS. 5–7, the at least partially ejected bale is disposed between the upwardly extending sidewall 84 and the contact surface 78 of the outwardly extending flanged portion of the door such that by partially closing the door upon the plug bale 64, the bale is securely held within the opening. As known to those skilled in the art, a strapping or banding station (not illustrated) can be disposed at a predetermined position downstream of the baling apparatus to securely bind the compacted bale, thereby preventing excessive enlargement of the bale. For example, the plug bale illustrated in FIGS. 6 and 7 has been banded to prevent subsequent enlargement of the plug bale.

In addition to the speed sensor 70, the door closure means 68 can include a hydraulic actuator 86 for partially closing the door 40. Typically, the same hydraulic actuator is employed by both the door closure means and the actuation means 56, however, separate hydraulic actuators can be employed without departing form the spirit and scope of the present invention. As described above in conjunction with the actuation means, the hydraulic actuator generally includes a hydraulic cylinder 64 and an associated hydraulic pressure source (not illustrated). In this embodiment, the door closure means further includes a pressure sensor 88 for repeatedly providing signals indicative of the hydraulic pressure supplied to the hydraulic actuator to partially close the door.

The door positioning controller 72 of this embodiment is also preferably responsive to the signals provided by the pressure sensor 88. Thus, the closure of the door 40 can also be halted once the hydraulic pressure supplied to the hydraulic actuator 86 to partially close the door exceeds a predetermined pressure, even if the speed with which the door was being closed has not yet fallen below the predetermined speed value. Therefore, according to this embodiment, the partial closure of the door is halted once the rate of closure of the door slows below a predetermined speed or once the hydraulic pressure required to further close the door exceeds a predetermined pressure value. In either instance, further closure of the door is halted and the plug bale 64 is securely held at least partially within the opening to the compaction chamber 24 during subsequent compaction operations.

Therefore, according to this embodiment of the present invention, compacted bales of various sizes and widths, including undersized bales and bales having a relatively high moisture content, can be readily secured, as plug bales, within the opening defined to the compaction chamber 24 by the at least partially open door 40. In particular, the controlled partial closure of the door against the plug bale 64 increases the relative frictional forces which secure the plug bale within the opening and prevent unwanted movement of the plug bale during the compaction of a succeeding bale.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. An apparatus for baling loose materials, the apparatus comprising:

a housing defining a longitudinally extending charging passage and a compaction chamber in communication with the charging passage, wherein the charging passage is adapted for receiving the loose materials;

a compacting ram assembly disposed at least partially within the charging passage and adapted for movement therein between a retracted position and an extended position, said compacting ram assembly having a compacting ram platen for urging the loose materials which are received within the charging passage into the compaction chamber and for compacting the loose materials within the compaction chamber into a bale as the compacting ram assembly moves forward from the retracted position to the extended position;

a compacting ram controller for controlling the movement of said compacting ram assembly such that bales of varying widths are formed; and a movable door assembly comprising:

a door movably mounted to said housing, said door having a leading edge portion; and actuation means for moving said door from an initial position to a final position, wherein said actuation means comprises means for determining the position of said door relative to the position of the compacting ram platen, and wherein said actuation means moves said door to the final position based upon the relative position of the compacting ram platen such that the leading edge portion of said door is in general alignment with the compacting ram platen to thereby define an opening from the compaction chamber having a size that corresponds to the position of the compacting ram platen and through which compacted bales of various widths are ejected.

2. An apparatus according to claim 1 wherein said actuation means comprises means for moving the leading edge portion of said door to a final position which is aligned with the compacting ram platen.

3. An apparatus according to claim 1 wherein said actuation means comprises means for moving the leading edge portion of said door to a final position which is rearward of the compacting ram platen.

4. An apparatus according to claim 1 wherein said position determining means comprises:

a door position sensor, mounted in a predetermined positional relationship to said door, for producing signals indicative of the position of said door; and a door positioning controller, responsive to the signals produced by said door position sensor, for determining the position of said door;

and wherein said actuation means further comprises a hydraulic actuator, responsive to said door positioning controller, for moving the door from the initial position to the final position in general alignment with the compacting ram platen.

5. An apparatus according to claim 4 wherein said compacting ram controller comprises a compacting ram position sensor, mounted in a predetermined positional relationship to the compacting ram platen, for producing signals indicative of the position of the compacting ram platen, and wherein said door positioning controller is responsive to said compacting ram controller for determining the position of said door relative to the position of the compacting ram platen.

6. An apparatus according to claim 1 further comprising a discharge ram assembly including a discharge ram platen for moving through the compaction chamber from a retracted position to an extended position once said door is moved to the final position such that the compacted bale is ejected through the opening from the compaction chamber, wherein said discharge ram platen forms a portion of the compaction chamber in the retracted position.

7. An apparatus for baling loose materials, the apparatus comprising:

a housing defining a charging passage and a compaction chamber in communication with the charging passage, wherein the charging passage is adapted for receiving the loose materials;

a compacting ram assembly disposed at least partially within the charging passage and adapted for movement therein such that the loose materials which are received within the charging passage are urged into the compaction chamber and are compacted into a bale therein;

discharge means for at least partially ejecting the compacted bale through an opening defined in the compaction chamber; and a moveable door assembly comprising:

a door having a leading edge portion, said door being slidably mounted to said housing and adapted to open to thereby define the opening from the compaction chamber through which the compacted bale is at least partially ejected by said discharge means; and door closure means for partially closing said door such that the leading edge portion of said door is urged against the at least partially ejected bale thereby retaining the bale at least partially within the opening to the compaction chamber during the compaction of a succeeding bale, said door closure means comprising:

a speed sensor for repeatedly determining the speed with which said door is being closed; and a door positioning controller, responsive to said speed sensor, for halting further closure of said door once said speed sensor determines that the speed with which said door is being closed is less than a predetermined speed such that the ejected bale is thereby securely held at least partially within the opening to the compaction chamber.

8. An apparatus according to claim 7 wherein said door closure means further comprises:

a hydraulic actuator for partially closing said door; and a pressure sensor for repeatedly providing signals indicative of the hydraulic pressure supplied to said hydraulic actuator to partially close said door, wherein said door positioning controller is responsive to the signals provided by said pressure sensor such that further closure of said door is halted once the hydraulic pressure supplied to the hydraulic actuator to partially close said door exceeds a predetermined pressure such that the ejected bale is thereby securely held at least partially within the opening to the compaction chamber.

9. An apparatus according to claim 7 wherein said speed sensor comprises:

a door position sensor, mounted in a predetermined positional relationship to said door, for producing signals indicative of the position of said door; and a timer for determining the respective times at which the signals indicative of the position of said door are produced by said door position sensor such that the speed with which said door is being closed can be determined.

10. An apparatus according to claim 7 wherein the leading edge portion of said door comprises an outwardly extending flanged portion having a contact surface for contacting and securely holding the ejected bale at least partially within the opening to the compaction chamber.

11. An apparatus according to claim 10 further comprising a discharge chute adjacent the opening to the compaction chamber, said discharge chute comprising:

a support surface for supporting the ejected bale; and an upwardly extending sidewall extending upwardly from an edge portion of said support surface such that the ejected bale is disposed between said upwardly extending sidewall and the contact surface of said door.

12. In combination with a baling apparatus comprising a housing defining both a longitudinally extending charging passage for receiving loose materials and a compaction chamber in communication with the charging passage and a compacting ram assembly adapted for longitudinal movement between a retracted position and an extended position within the charging passage, wherein the compacting ram assembly has a compacting ram platen for urging the loose materials which are received within the charging passage into the compaction chamber and for compacting the loose materials within the compaction chamber into bales of varying widths as the compacting ram assembly moves longitudinally forward from the retracted position to the extended position, a movable door assembly comprising:

a door slidably mounted to the housing of the baling apparatus, said door having a leading edge portion; and actuation means for moving said door from an initial position to a final position once a bale has been formed and the movement of the compacting ram assembly has been halted, wherein said actuation means comprises means for determining the position of said door relative to the position of the compacting ram platen, and wherein said actuation means moves said door to the final position based upon the relative position of the compacting ram platen such that the leading edge portion of said door is at least as rearward as the compacting ram platen to thereby define an opening from the compaction chamber having a width at least as large as the width of the compacted bale and through which the compacted bale is ejected.

13. A movable door assembly according to claim 12 wherein the compaction chamber of the baling apparatus has a first predetermined width, and wherein said actuation means of the movable door assembly is adapted to move said door longitudinally to a final position to thereby define an opening having a second predetermined width, greater than the first predetermined width, such that a compacted bale having a width greater than the width of the compaction chamber can be ejected.

14. A movable door assembly according to claim 12 wherein said actuation means comprises means for moving the leading edge portion of said door longitudinally to a final position which is longitudinally aligned with the compacting ram platen.

15. A movable door assembly according to claim 12 wherein said actuation means comprises means for moving the leading edge portion of said door longitudinally to a final position which is longitudinally rearward of the compacting ram platen.

16. A method of baling loose materials with a baling apparatus having a controllably positioned door, the method comprising the steps of:

receiving loose materials in a charging passage defined within the baling apparatus;

moving a compacting ram platen within the charging passage between a retracted position and an extended position, said step of moving the compacting ram platen comprising the steps of urging the loose materials which are received within the charging passage into an adjacent compaction chamber, and compacting the loose materials within the compaction chamber into a bale as the compacting ram platen is moved from the retracted position to the extended position;

halting the movement of the compacting ram platen once a bale is formed;

moving a leading edge portion of the door from an initial position to a final position, wherein said moving step comprises the step of determining the position of the door relative to the position of the halted compacting ram platen such that the final position is in general alignment with the compacting ram platen to thereby define an opening from the compaction chamber which has a size that corresponds to the position of the compacting ram platen; and ejecting the compacted bale through the opening from the compaction chamber defined by the door.

17. A method according to claim 16 wherein said step of moving the leading edge portion of the door comprises the step of moving the leading edge portion of the door to a final position which is aligned with the compacting ram platen.

18. A method according to claim 16 wherein said step of moving the leading edge portion of the door comprises the step of moving the leading edge portion of the door to a final position which is rearward of the compacting ram platen.

19. A method according to claim 16 wherein said step of determining the position of the door relative to the position of the halted compacting ram platen comprises:

determining the position of the door; and determining the position of the compacting ram platen; and wherein said moving step further comprises hydraulically moving the door such that the final position of the door is in general alignment with the compacting ram platen.

20. A method according to claim 16 wherein said ejecting step comprises the step of moving a discharge ram platen through the compaction chamber from a retracted position to an extended position such that the compacted bale is ejected through the opening from the compaction chamber.

21. A method for securely holding a compacted bale at least partially within an opening from a compaction chamber of a baling apparatus, the method comprising the steps of:

receiving loose materials in a charging passage defined within the baling apparatus;

moving a compacting ram platen through the charging passage, said step of moving the compacting ram platen comprises the steps of urging the loose materials which are received within the charging passage into the adjacent compaction chamber, and compacting the loose materials within the compaction chamber into a bale as the compacting ram platen is moved from a retracted position to an extended position;

ejecting the compacted bale at least partially through the opening from the compaction chamber;

retaining the ejected bale at least partially within the opening during the compaction of a succeeding bale, wherein said retaining step comprising the step of partially closing the opening with a door such that the leading edge portion of the door is urged against the at least partially ejected bale, and wherein said step of partially closing the opening comprises the steps of:

repeatedly determining the speed with which said door is being closed; and halting further closure of the door once the speed with which the door is being closed is less than a predetermined speed such that the at least partially ejected bale is thereby securely held at least partially within the opening to the compaction chamber.

22. A method according to claim 21 wherein said step of partially closing the opening comprises the steps of:

moving the door hydraulically with a hydraulic actuator;

repeatedly measuring the hydraulic pressure supplied to the hydraulic actuator to move the door; and halting further closure of the door once the hydraulic pressure required to move the door exceeds a predetermined pressure such that the ejected bale is thereby securely held at least partially within the opening to the compaction chamber.

23. A method according to claim 21 wherein said step of repeatedly determining the speed comprises the steps of:

repeatedly measuring the position of said door; and determining the respective times at which the position of the door is measured such that the speed with which said door is being closed can be determined.

* * * * *